US009789386B2

(12) United States Patent
Yu et al.

(10) Patent No.: US 9,789,386 B2
(45) Date of Patent: Oct. 17, 2017

(54) MOUNTED GAME BOARD

(71) Applicant: Mattel, Inc., El Segundo, CA (US)

(72) Inventors: Brian Yu, Los Angeles, CA (US); Damon Saddler, Inglewood, CA (US); Paul James, El Segundo, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 14/046,812

(22) Filed: Oct. 4, 2013

(65) Prior Publication Data

US 2014/0175744 A1 Jun. 26, 2014

Related U.S. Application Data

(60) Provisional application No. 61/710,275, filed on Oct. 5, 2012.

(51) Int. Cl.
*A63F 3/00* (2006.01)
*A63F 9/06* (2006.01)

(52) U.S. Cl.
CPC ..... *A63F 3/00533* (2013.01); *A63F 3/0023* (2013.01); *A63F 3/00694* (2013.01); *A63F 2003/0063* (2013.01); *A63F 2003/00406* (2013.01); *A63F 2003/00514* (2013.01); *A63F 2003/00536* (2013.01); *A63F 2009/0645* (2013.01); *Y10T 29/49826* (2015.01)

(58) Field of Classification Search
CPC .. A63F 2003/00536; A63F 2003/00406; A63F 2003/00514; A63F 2009/0645; A63F 2003/0063; A63F 3/00694; A63F 3/0023; A63F 3/00533; Y10T 29/49826
USPC ..... 273/239, 286, 285, 287
See application file for complete search history.

(56) References Cited

U.S. PATENT DOCUMENTS 1,398,869 A * 11/1921 Le Roy ..... E06B 9/52 160/374
1,493,159 A * 5/1924 Milmoe ..... B42F 5/06 40/778
1,708,318 A * 4/1929 Little ..... A63F 1/06 273/148 R (Continued)

FOREIGN PATENT DOCUMENTS

CN 1882262 12/2006

OTHER PUBLICATIONS

"Board Games as Wall Art from Wisteria" http://www.apartment-therapy.com/board-games-as-wall-art-from-w-38344.

(Continued)

*Primary Examiner* — Vishu Mendiratta
(74) *Attorney, Agent, or Firm* — Kolisch Hartwell, P.C.

(57) ABSTRACT

A game board assembly is disclosed herein. The game board assembly includes a foldable game board and a plurality of mounts. The foldable game board has a main portion and a plurality of peripheral edge portions that surround the main portion. The game board has a planar configuration where the main portion and the plurality of peripheral edge portions are positioned to be substantially co-planar with one another. The peripheral edge portions are selectively foldable to be non-planar with respect to the main portion. The mounts are each configured to engage the game board in the planar configuration. The mounts are configured to releaseably mount to a surface.

17 Claims, 4 Drawing Sheets

(56) References Cited

U.S. PATENT DOCUMENTS 2,075,354 A * 3/1937 Monier ..... A47B 25/00 108/131
2,081,722 A * 5/1937 Weinzierl ..... 40/782
2,085,460 A * 6/1937 Williams ..... B65D 5/2009 229/113
2,540,907 A * 2/1951 Paschal ..... A47G 1/0644 40/744
2,586,153 A * 2/1952 Eisman ..... 108/90
2,640,749 A * 6/1953 Shanahan ..... 108/176
2,772,886 A * 12/1956 Parmele ..... 273/309
2,791,784 A * 5/1957 Tomsic ..... 5/496
3,137,088 A * 6/1964 Spertus ..... B44D 3/18 160/378
3,194,561 A * 7/1965 Schumann ..... A47B 25/00 273/239
3,557,856 A * 1/1971 Berman ..... 108/90
3,914,887 A * 10/1975 Newman ..... B44D 3/185 160/378
3,924,343 A * 12/1975 Johnson ..... B44D 3/185 160/374.1
4,030,736 A 6/1977 Petrusek
4,268,000 A * 5/1981 Ulm ..... B44C 5/02 156/163
4,386,777 A 6/1983 Prehodka
4,398,893 A 8/1983 Johns
4,519,151 A * 5/1985 Johnson ..... B44D 3/185 160/374.1
4,543,278 A 9/1985 Ackerman
4,793,725 A 12/1988 Cheng
4,919,436 A 4/1990 Buselli
4,949,977 A 8/1990 Smith
4,971,333 A 11/1990 Buselli
4,989,880 A * 2/1991 Gettemeier ..... 273/336
5,040,800 A 8/1991 Ulan
5,058,297 A * 10/1991 McGinnis ..... 40/782
5,076,432 A * 12/1991 Wolf ..... B65D 5/5021 206/449
5,078,642 A 1/1992 Glessner
5,113,611 A * 5/1992 Rosson ..... B44D 3/185 101/127.1
5,158,295 A 10/1992 Shilling
5,203,847 A 4/1993 Butt
5,244,212 A * 9/1993 Bendit ..... 273/239
5,249,802 A 10/1993 McCarthy
5,255,458 A * 10/1993 Piel ..... A47G 1/0638 24/487
RE34,461 E 11/1993 Buselli
5,265,358 A * 11/1993 Borod ..... A47G 1/10 40/758
5,267,732 A 12/1993 Bowen et al.
5,342,048 A 8/1994 Jones et al.
5,385,472 A 1/1995 Mullin
5,503,400 A * 4/1996 Silva ..... A63F 3/02 273/239
5,513,852 A 5/1996 Robinson
5,533,902 A 7/1996 Miller
5,536,017 A 7/1996 Salisian
5,603,504 A 2/1997 Powell
5,607,339 A 3/1997 Kramer
5,624,118 A 4/1997 Gottesman
5,664,780 A 9/1997 Bricker
5,833,239 A 11/1998 Eleidjian
5,836,588 A 11/1998 Gerson
5,871,214 A 2/1999 Hummel
5,947,437 A * 9/1999 Tate ..... A47G 1/0638 248/216.1
6,056,620 A 5/2000 Tobin
6,105,790 A 8/2000 Parks
6,116,605 A 9/2000 Davey, III
6,203,327 B1 3/2001 Ottrando
6,293,550 B1 9/2001 Zeitlin
6,299,172 B1 10/2001 McMurray
6,638,134 B1 10/2003 Hewitt
6,718,709 B2 4/2004 Koutras et al.
7,484,732 B2 2/2009 Adams
7,770,811 B2 8/2010 Belding
7,775,523 B2 8/2010 Adams
7,908,718 B2 3/2011 Glasser
7,918,047 B1 * 4/2011 Ngan ..... A47G 1/0633 40/778
8,118,306 B2 2/2012 Kean
8,608,527 B2 12/2013 O'Connor et al.
8,944,882 B2 2/2015 O'Connor et al.
2005/0253336 A1 11/2005 Schwartz
2006/0043673 A1 3/2006 Brown
2007/0126183 A1 6/2007 Willett
2008/0064295 A1 3/2008 Abrams
2010/0304639 A1 12/2010 Payne et al.
2011/0070803 A1 3/2011 Hoffman et al.
2011/0163498 A1 7/2011 Escobar
2012/0108139 A1 5/2012 Horowitz et al.
2012/0164914 A1 6/2012 O'Connor et al.
2013/0205631 A1 * 8/2013 Steichen ..... A47G 1/0633 40/743
2014/0183272 A1 7/2014 O'Connor et al.
2015/0115050 A1 4/2015 O'Connor et al.

OTHER PUBLICATIONS

"Wall-Mounted Board Games" By: Cecilia Biemann; Trend Hunter Magazine.
Pinterest.com/pin/35888128250097471/; From ohdeedoh.com.
State Intellectual Property Office of the P.R.C., Office Action for Chinese Patent Application No. 201310756887.2, dated Oct. 8, 2016, 14 pages.

* cited by examiner

MOUNTED GAME BOARD

CROSS REFERENCE TO RELATED APPLICATIONS

This application claims the benefit of U.S. Provisional Patent Application Ser. No. 61/710,275 filed Oct. 5, 2012, the contents of which are incorporated herein by reference thereto.

BACKGROUND

Various embodiments of the present invention are related to toys. In particular, the various embodiments are related to mounts for a game board that may be mounted to a surface.

Game boards have been available for many years and generally include a substantially horizontal surface. Tokens or other types of game pieces may be placed upon the game board on the horizontal surface.

Accordingly, it is desirable to provide game board with features that provide unique mounting configurations.

SUMMARY OF THE INVENTION

In one embodiment, a game board assembly is disclosed and includes a foldable game board and a plurality of mounts. The foldable game board has a main portion and a plurality of peripheral edge portions that surround the main portion. The game board has a planar configuration where the main portion and the plurality of peripheral edge portions are positioned to be substantially co-planar with one another. The peripheral edge portions are selectively foldable to be non-planar with respect to the main portion. The mounts are each configured to engage the game board in the planar configuration. The mounts are configured to releasably mount to a surface. The game board is foldable at the peripheral edge portions to fold from the planar configuration into a folded configuration. When the game board is in the folded configuration, the game board may be received by a container.

In another embodiment, a game board assembly is disclosed and includes a foldable game board and a plurality of mounts. The foldable game board has a main portion and a plurality of peripheral edge portions that surround the main portion. The game board has a planar configuration where the main portion and the plurality of peripheral edge portions are positioned to be substantially co-planar with one another. The peripheral edge portions are selectively foldable along an edge portion of the game board to be non-planar with respect to the main portion. The mounts are each configured to engage the game board being in the planar configuration. The mounts are configured to releasably mount to a surface. The mounts and the game board cooperate together if the game board is in the planar configuration to create an outer periphery. The game board is foldable at the peripheral edge portions to fold from the planar configuration into a folded configuration. When the game board is in the folded configuration, the game board may be received by a container.

In yet another embodiment, a method of mounting a game board assembly to a surface is disclosed. The game board assembly includes a foldable game board having a planar configuration. The method includes unfolding the game board from a folded configuration. A plurality of peripheral edge portions are folded to be non-planar with respect to a main portion of the game board in the folded configuration. The method includes securing a plurality of mounts to the game board. The method includes removably mounting the game board to the surface by the plurality of mounts. The game board assembly is in the planar configuration if mounted to the surface. The main portion and the plurality of peripheral edge portions are positioned to be substantially co-planar with one another in the planar configuration.

BRIEF DESCRIPTION OF THE DRAWINGS

Other features, advantages and details appear, by way of example only, in the following description of embodiments, the description referring to the drawings in which:

FIG. 8 is a process flow diagram.

DETAILED DESCRIPTION

Figure 1:
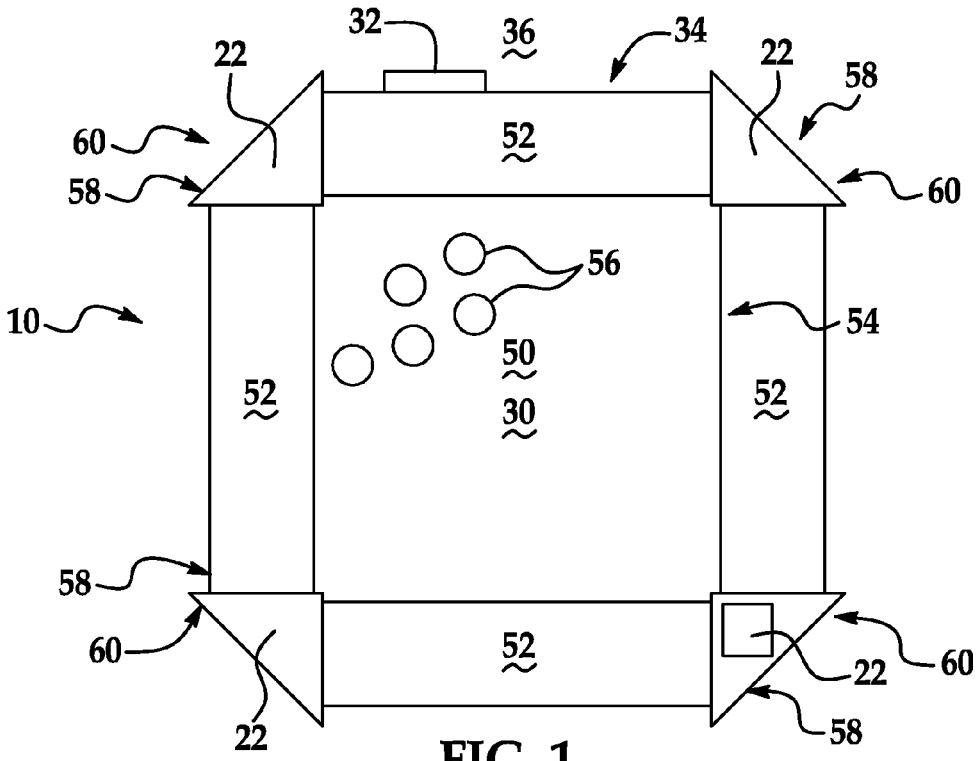
FIGS. 1-8 illustrate exemplary embodiments of a game board assembly according to the present invention, where FIGS. 1-4 generally illustrate the game board assembly, FIGS. 5-7 generally illustrate mounts.
Figure 2:
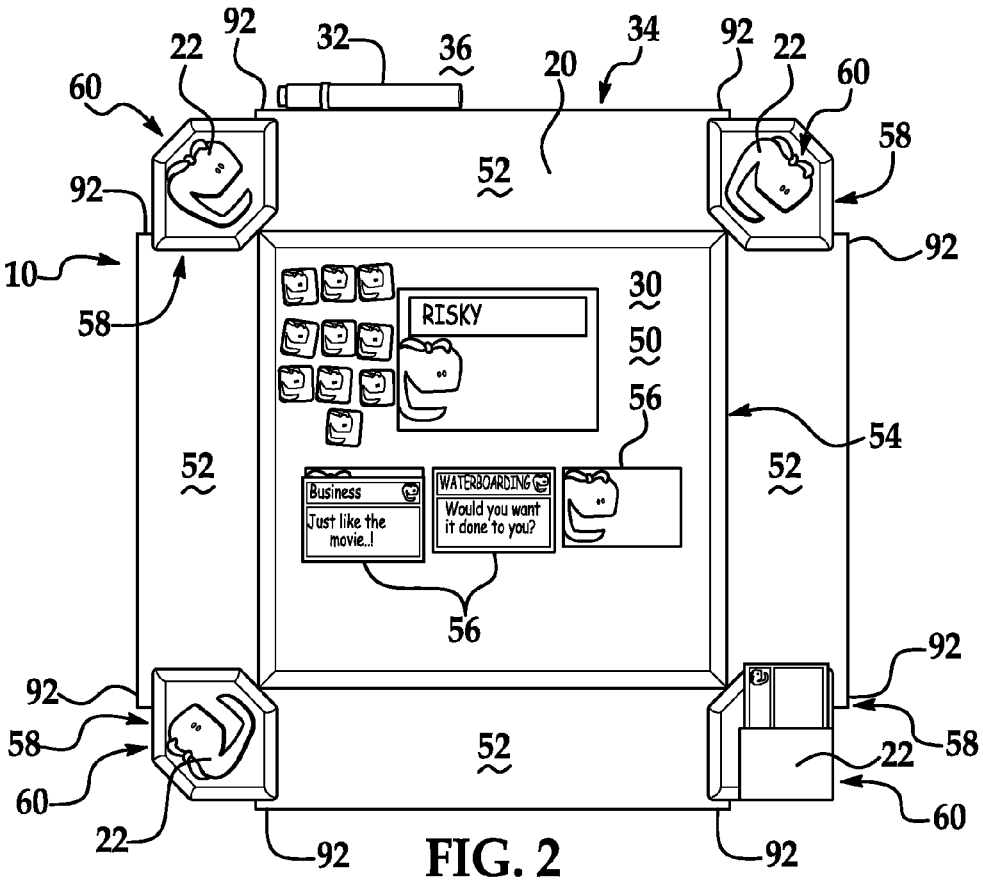
Figure 3:
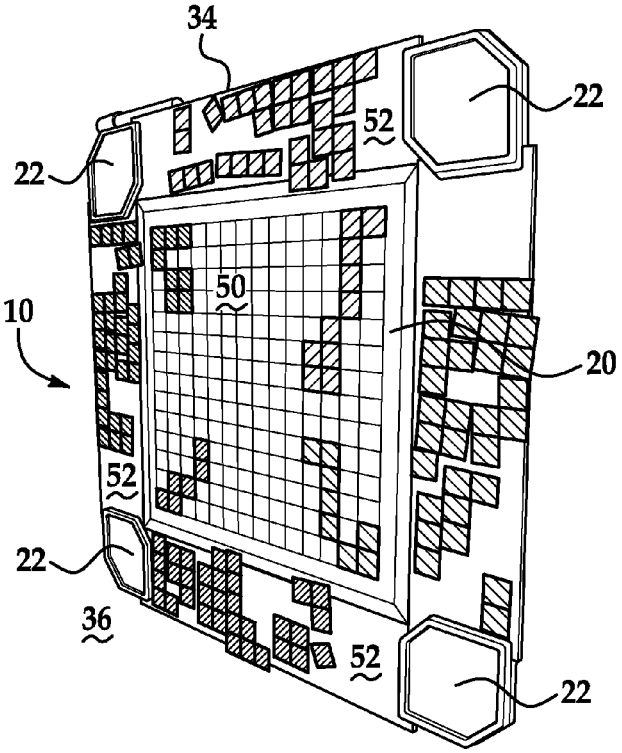

Referring now to FIG. 1, a game board assembly 10 in accordance with an exemplary embodiment of the present invention is illustrated. In the embodiment as shown, the game board assembly 10 includes a foldable game board 20 and a plurality of mounts 22. The game board 20 may be any type of game board having a surface 30. In some exemplary embodiments, at least a portion of the surface 30 may be a non-permanent writing surface such as, for example, a dry-erase board. Individuals may use a writing utensil 32 such as, for example, a dry-erase marker, to write messages or draw illustrations on the surface 30. In the exemplary embodiments as shown in FIGS. 1-3, the game board 20 and the mounts 22 create an outer periphery 34. In the embodiments as illustrated, the outer periphery 34 of the game board assembly 10 is generally square. Of course, other configurations are considered to be within the scope of the present invention, and the game board assembly 10 is not limited to the specific configurations illustrated herein. For example, the outer periphery 34 of the game board assembly 10 may be generally rectangular or generally hexagonal as well.

In the embodiments as shown in FIGS. 1-4, the game board assembly 10 may be selectively mounted to a generally planar surface 36 such as, for example, a wall via the mounts 22. Specifically, each of the mounts 22 may be releasably attached or mounted to the surface 36. The mounts 22 secure the game board 20 to the surface 36. In one embodiment, a rear surface (not shown) of the mounts 22 may include an adhesive to releasably secure the mounts 22 to the surface 36. An example of one type of mechanism for securing mounts 22 to the wall is found in U.S. patent application Ser. No. 13/220,364, filed on Aug. 29, 2011, and U.S. Provisional Patent Applications Ser. Nos. 61/377,743, filed on Aug. 27, 2010, and 61/480,793, filed on Apr. 29, 2011, the contents each of which are incorporated herein by reference thereto in their entirety. In one embodiment, the mount may comprise a portion of mounting members illustrated in the aforementioned patent applications. One non-limiting example of such an adhesive is commercially available from the 3M Corporation sold under the trademark COMMAND BRAND STRIPS. Of course, any other type of adhesive may be utilized as well. Also, although an adhesive is discussed, it is understood that other approaches may be used as well to secure the mounts 22 to the surface 36.

The game board 20 includes a main portion 50 and a plurality of peripheral edge portions 52. The peripheral edge portions 52 surround the main portion 50. In some non-limiting embodiments, the peripheral edge portions 52 provide each player of a game with their own player area when the peripheral edge portions 52 are substantially co-planar with respect to the main portion 50. Accordingly, each player using the game board 20 has an associated peripheral edge portion 52 to use in a game played on the main portion 50. For example and as illustrated in at least FIGS. 3 and 4, players of the game can store or secure their un-played game pieces or game tokens on their corresponding player area defined by peripheral edge portion 52. This player area provides the player with a convenient location to store the game pieces or game tokens that are not being specifically used on the main portion 50 but are necessary for gameplay and are desirable to have in close proximity to the main portion 50. Still further, the peripheral edge portions 52 may define a surface area onto which a user may tally scores or write down other indicia during gameplay using, for example, a dry erase marker.

In the embodiments as shown in FIGS. 1-4, the peripheral edge portions 52 are generally rectangular. However, it is to be understood that the peripheral edge portions 52 may utilize other shapes as well. Each of the peripheral edge portions 52 are selectively foldable along an edge portion 54 where the peripheral edge portion 52 joins with the main portion 50 of the game board 20.

Referring to FIG. 1, the peripheral edge portions 52 cooperate with one another to create corner openings 58 located along the outer periphery 34 of the game board 20. Specifically, two of the peripheral edge portions 52 cooperate with one another to define or create a corner opening 58. The corner openings 58 are generally located along each corner 60 of the game board 20. Each of the mounts 22 are configured to fit within one of the corner openings 58. Each of the mounts 22 selectively receives two of the peripheral edge portions 52. In some embodiments, the mounts 22 may extend to receive a corner of the main portion 50 of the game board 20 to add extra stability in holding the game board 20 in place (see, FIG. 1). In other embodiments, the mounts 22 include a cutout that avoids covering any part of the main portion 50 of the game board 20, so that playable game board space is maximized (see, FIGS. 2-4). In the exemplary embodiments as shown, the game board 20 and the mounts 22 cooperate together to create the outer periphery 34.

The surface 30 of the game board 20 may be configured to receive and secure various types of game tokens 56 and/or the writing utensil 32. Similarly, the peripheral edge portions 52 are also configured to receive and secure various types of game tokens 56 and/or the writing utensil 32. For example, the game board 20 may be constructed to include a ferromagnetic material, such as steel laminated with paper, and the game tokens 56 may be constructed to include a permanent magnet, such that the game tokens 56 may be releasably secured to the game board 20 (e.g., the writing utensil 32 may include a permanent magnet, for example). Therefore, if the game board 20 is oriented in a vertical configuration (e.g., the surface 36 is a substantially vertical wall), then the game tokens 56 will not generally slide off the game board 20. It is to be understood that while magnets and magnetic material is discussed, other fastening techniques may be used as well to releasably secure the game tokes 56 to the game board 20.

Figure 4:
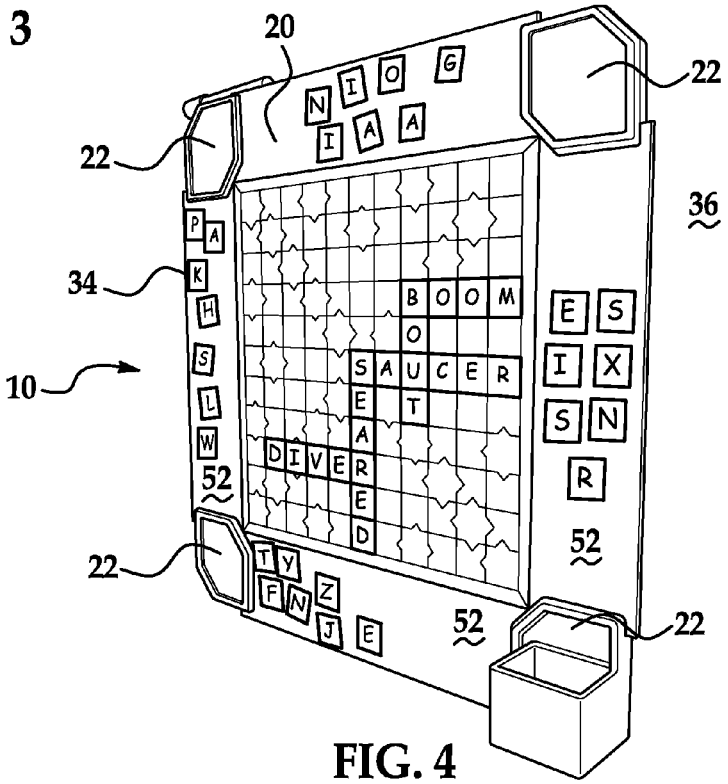

The game board 20 may be configured to play various types of games. Specifically, the surface 30 of the game board 20 may include markings or other features aiding in the play of a game. In some embodiments, the game board 20 may be a two-sided game board, where markings for one type of game are printed on a first surface 30, and markings for another game are printed on an opposing surface (not shown). Markings associated with any type of game may be printed on the game board 20. For example, FIG. 2 illustrates a game associated with the trademark APPLES TO APPLES. As seen in FIG. 2, various game tokens 56 (e.g., the cards) associated with the APPLES TO APPLES game are shown. In another embodiment, FIG. 3 illustrates a game associated with the trademark BLOKUS. As seen in FIG. 3, various game tokens 56 (e.g., the various shaped tiles) associated with the BLOKUS game are shown. In yet another non-limiting embodiment, FIG. 4 illustrates a game associated with the trademark SCRABBLE. As seen in FIG. 4, various game tokens 56 (e.g., the lettered tiles) associated with the SCRABBLE game are shown. Of course, other types of game may be utilized as well. For example, in another approach, the game board 20 may be configured to play a game of chess or checkers.

In one example, the game board 20 is configured such that markings for a game associated with the trademark APPLES TO APPLES is printed on the first surface 30, and markings for a game associated with the trademark BLOKUS is printed on the opposing surface (not shown). Of course, any combination of games may be used as well.

The game board 20 is foldable along the edge portions 54. In a planar configuration as shown in FIGS. 1-4, the peripheral edge portions 52 are each positioned to be substantially co-planar with the main portion 50 of the game board 20. That is, the peripheral edge portions 52 and the main portion 50 are both aligned with one another in the substantially the same plane when the game board 20 is in the planar configuration, and both the peripheral edge portions 52 and the main portion 50 are substantially parallel with the surface 36. The mounts 22 secure the peripheral edge portions 52 to the surface 36. The mounts 22 also align the peripheral edge portions 52 in the planar configuration.

When the mounts 22 are removed, the peripheral edge portions 52 may be folded along the edge portions 45. Thus, the peripheral edge portions 52 are non-planar with the main portion 50 of the game board 20. That is, the peripheral edge portions 52 are not in the same plane as the main portion 50 of the game board 20 or in other words the surfaces of the peripheral edge portions 52 and the main portion 50 do not extend adjacent to each other in the same plane for example as illustrated in at least FIGS. 1-4. The game board 20 is configured to be foldable at the edge portions 45 to fold from the planar configuration into a folded configuration (not shown). That is, the peripheral edge portions 52 are hingeably connected to the main portion 50 of the game board 20 at the edge portions 42 such that the peripheral edge portions 52 may rotate about the edge portions 45. When the game board 20 is in the folded configuration, the game board 20 may be received by a separate container (e.g., a game box).

Accordingly, the peripheral edge portions 52 are configured to be manipulated from a first position or a substantially co-planar configuration (illustrated in the attached FIGS.) with respect to the main portion 50 of the game board 20 into a second position or a substantially non-coplanar configuration with respect to the main portion 50 of the game board 20. It being understood that the second position of the peripheral edge portion 52 corresponds to any configuration of peripheral edge portions 52 with respect to a portion 50 of the game board 20 as long as they are not coplanar and their surfaces 30 are contiguous (e.g., extend outwardly in the same plane) as described above and as illustrated in at least FIGS. 1-4.

When at least one of the peripheral edge portions 52 are in the first position, the game board 20, main portion 50 and its associated peripheral edge portions 52 will have a first perimeter or periphery. In the non-planar configuration, where all of the peripheral edge portions 52 are folded into the second position, the game board 20 will have a second perimeter or periphery. The second perimeter for the illustrated embodiments corresponds to the perimeter periphery of the main portion 50, which is smaller than the first perimeter or periphery. The first perimeter or periphery would generally be larger than the second perimeter because the first perimeter generally includes multiple edges from each of the peripheral edge portions 52. Once the peripheral edge portions 52 are folded into their second position the periphery or perimeter of the game board 20 is reduced to as much as that of the main portion 50. This reduced periphery or perimeter, and generally the reduced area that accompanies it, advantageously allows for storage of the game board 20 into a smaller box. In addition, by having peripheral edge portions 52 foldably secured to edge portions of the main portion 50 of the game board 20, the main portion 50 of the game board 20 itself can have a larger perimeter or periphery while still allowing for it to be stowable into a desired package or box. Prior to use, the game board 20 is removed from its package and then the peripheral edge portions 52 are manipulated into their first position thereby creating player areas around the perimeter of the main portion 50 of the game board 20. In addition and as mentioned above, two adjacent peripheral edge portions 52 interface with each of the mounts 22. Alternatively and when the peripheral edge portions 52 are in their second position, the peripheral edge portions 52 can be used to support the main portion 50 of the game board 20 above a surface that the peripheral edge portions 52 are resting upon.

Figure 5:
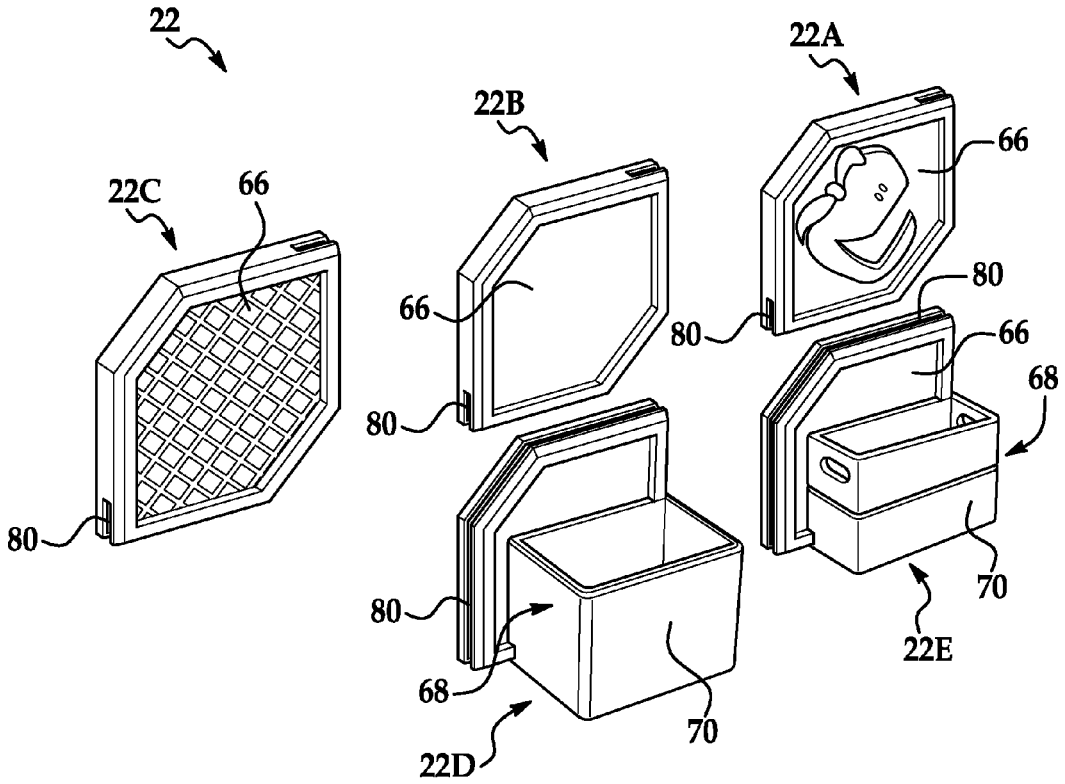

FIG. 5 is a perspective view of various types of mounts 22 that may be available. In the embodiments as shown, each of the mounts 22 may have a logo or design printed or molded along a front surface 66 of the mount 22. For example, the mount 22A has an apple design associated with the trademark APPLES TO APPLES game molded in the front surface 66. The mounts 22B and 22C may have other trademarks or features molded along the front surface 66. The mounts 22D and 22E each have a container 68 located along the front surface 66. The container 66 may be used for receiving objects such as, for example, the game tokens 56 (shown in FIGS. 1-4). The mount 22D may also have a trademark molded along a front surface 70 of the container 68 and the mount 22E may also have a trademark or design molded along the front surface 70. Of course, any other configuration is considered to be within the scope of exemplary embodiments of the present invention, and the mounts 22A-22E are not limited to the specific configurations illustrated herein.

Referring now to FIG. 5, each mount 22 includes a slot 80 that is configured to receive a portion of two of the peripheral edge portions 52 (FIGS. 1-2). Specifically, referring to FIG. 6, each slot 80 extends along a first edge 82, a chamfered or curved edge 84, and a second edge 86 of the mount 22. Referring to FIG. 7, the slot 80 also wraps or extends partially to a third edge 88 and a fourth edge 90. In some embodiments, the inner surface or opposing surfaces located within slot 80 may be configured to have raised ridges, features or protrusions 81 located within the slot 80 and these ridges or protrusions 81 aid in gripping edge portions 52 when they are inserted into the slot 80. For example, the distance between the raised ridges 81 and an opposing surface of the slot or alternatively another raised ridge in a facing spaced relationship may be slightly less than the thickness of the edge portions 52 when they are inserted into the slot. Thus, mounts 22 are snugly and removably or releasably secured to the peripheral edge portions 52. It should be noted that while FIGS. 1-6 discuss the peripheral edge portions 52 being received by the slot 80 in the mounts 22, other approaches may be used as well to secure the mounts 22 to the game board 20. For example, in other embodiments, the mounts 22 may engage a portion of the main body 50 of the game board 20 instead of the peripheral edge portions 52.

Figure 6:
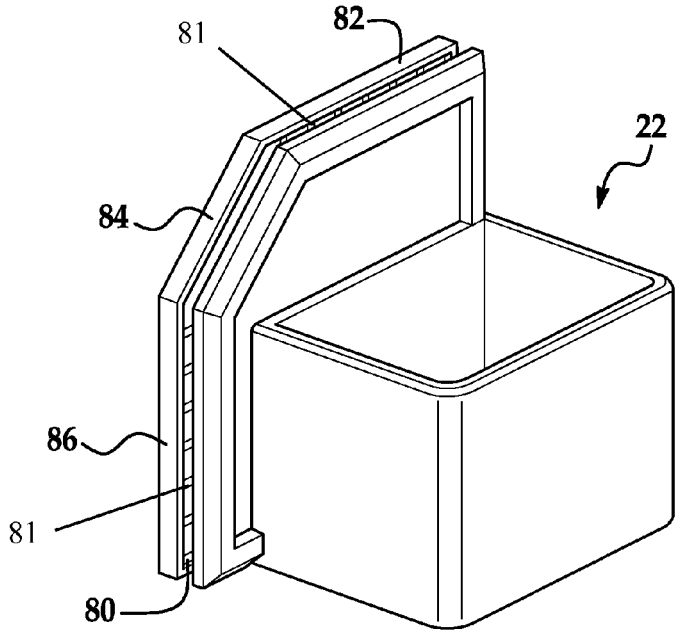
Figure 7:
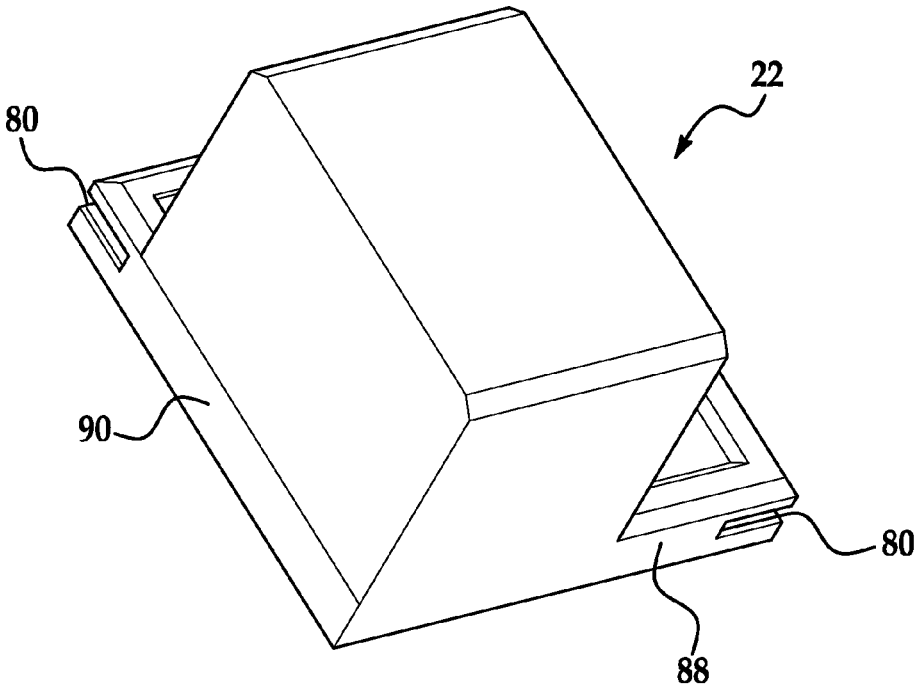
Figure 8:
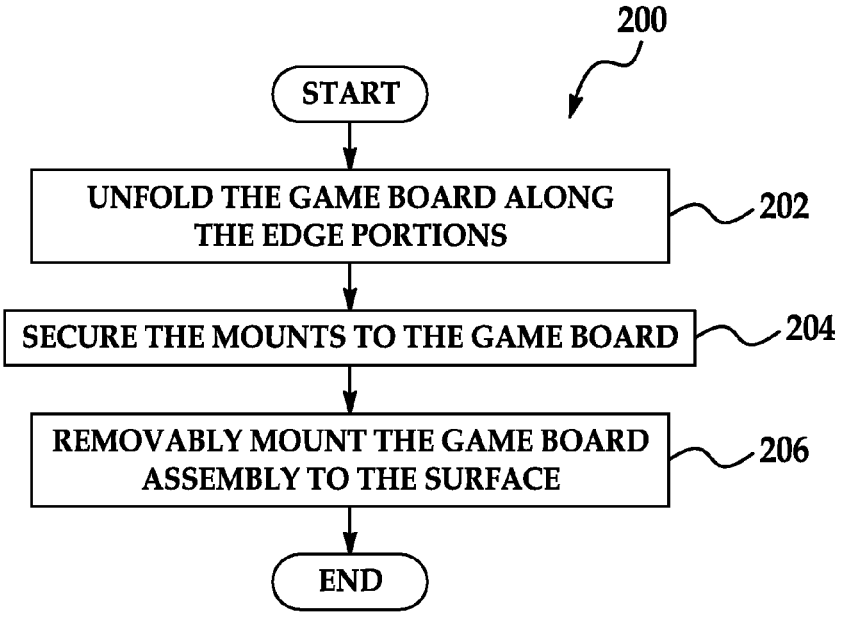

Referring now to FIGS. 1-7, each of the mounts 22 are configured to receive a side edge 92 (shown in FIG. 2) of two of the peripheral edge portions 52 of the game board 20. A user may assemble the game board assembly 10 from the folded configuration into the planar configuration (FIGS. 1-4) according to the method 200 shown in FIG. 8. The method 200 may begin at step 202, where a user unfolds the game board 20 along the edge portions 54. In some embodiments, the game board 20 is removed from a container (e.g., a game box) while in the folded configuration. In step 204, a user may then secure each of the mounts 22 to the game board 20 by sliding a portion of the peripheral edge portions 52 (FIGS. 1-3) into the slots 80 of the mounts (FIGS. 5-7). In step 206, a user may then removably mount the game board assembly 10 to the surface 36. Specifically, each of the mounts 22 may be releasably attached to the surface 36 by an adhesive or another approach. When releasably attached to the surface 36, the game board assembly 10 is now in the planar configuration. Method 200 may then terminate.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A game board assembly, comprising:

a foldable game board having a main portion and a plurality of peripheral edge portions that surround the main portion, the game board having a planar configuration wherein the main portion and the plurality of peripheral edge portions are positioned to be substantially co-planar with one another, wherein the plurality of peripheral edge portions are selectively foldable to be non-planar with respect to the main portion; and, wherein the plurality of peripheral edge portions are predefined and join the main portion of the game board a plurality of mounts that are each configured, when the game board is in the planar configuration, to engage both (i) the game board and (ii) a mounting surface that is separate and distinct from both the plurality of mounts and the game board, the plurality of mounts each being configured to be releasably mounted to the mounting surface, wherein the plurality of mounts each include opposed first and second surfaces, the first and second surfaces being parallel to each other and having a gap therebetween to define a slot that is configured to releasably receive a portion of two adjacent peripheral edge portions when the game board is in the planar configuration such that, when received in the slot, the portion of two adjacent peripheral edge portions is parallel to the first and second surfaces.

2. The game board assembly of claim 1, wherein the plurality of peripheral edge portions are selectively foldable along an edge portion of the game board.

3. The game board assembly of claim 1, wherein the plurality of mounts and the plurality of peripheral edge portions of the game board cooperate together when the game board is in the first planar configuration in order to create an outer periphery of the game board assembly.

4. The game board assembly of claim 3, wherein the outer periphery is one of generally square, generally hexagonal, and generally rectangular.

5. The game board assembly of claim 1, wherein the plurality of peripheral edge portions cooperate with one another to create corner openings located along an outer periphery of the game board when the game board is in the planar configuration, each of the corner openings being configured to receive one of the plurality of mounts.

6. The game board assembly of claim 5, wherein each of the plurality of mounts are configured to be received within the corner openings.

7. The game board assembly of claim 1, wherein at least one of the first and second surfaces includes raised ridges configured to grip the portion of two adjacent peripheral edge portions when the portion of two adjacent peripheral edge portions is inserted into the slot.

8. The game board assembly of claim 1, wherein the plurality of mounts are releaseably attached to the mounting surface by an adhesive.

9. The game board assembly of claim 1, wherein at least one of the plurality of mounts includes a container.

10. The game board assembly of claim 1, wherein at least a portion of a surface of the game board is a non-permanent writing surface.

11. The game board assembly of claim 1, wherein the game board is constructed from a ferromagnetic material and a plurality of game tokens are constructed from a permanent magnet such that the game tokens are releaseably secured to the game board.

12. The game board assembly of claim 1, wherein the plurality of mounts each includes a plurality of edges, and the slot extends along at least a portion of each of the plurality of edges.

13. The game board assembly of claim 12, wherein the plurality of edges includes five edges.

14. The game board assembly of claim 12, wherein the container includes a plurality of side walls and a bottom wall, each side wall of the plurality of side walls includes an edge that is attached to, or formed with, a different edge of the bottom wall.

15. The game board assembly of claim 14, wherein the container is along a front surface of the at least one of the plurality of mounts and is external to the slot.

16. A game board assembly, comprising:

a foldable game board having:

a main portion having edge portions, and a plurality of peripheral edge portions that surround and join the main portion at the edge portions, the plurality of peripheral edge portions having side edges, wherein the plurality of peripheral edge portions are predefined, wherein the game board includes a planar configuration in which the main portion and the plurality of peripheral edge portions are positioned to be substantially co-planar with one another, and a non-planar configuration in which the plurality of peripheral edge portions are folded along the edge portions of the game board to be non-planar with respect to the main portion; and a plurality of mounts that are each configured, when the game board is in the planar configuration, to (i) engage at least two of the plurality of peripheral edge portions and (ii) releaseably mount the game board to a mounting surface that is separate and distinct from the game board, wherein the plurality of mounts and the game board cooperate together when the game board is in the planar configuration in order to create an outer periphery, wherein the plurality of mounts each include a slot that is configured to releasably receive a portion of two adjacent peripheral edge portions and an inner surface located within the slot includes raised ridges configured to grip the portion of two adjacent peripheral edge portions when the portion of two adjacent peripheral edge portions is inserted into the slot, wherein the side edges of the plurality of peripheral edge portions define corner openings therebetween when the game board is in the planar configuration, the corner openings being located along the outer periphery of the game board, and wherein the side edges of the plurality of peripheral edge portions are no longer co-planar with respect to the main portion when the game board is in the non-planar configuration, and the outer periphery is reduced when the game board is in the non-planar configuration.

17. The game board assembly of claim 16, wherein each of the plurality of mounts are configured to be received within the corner openings.

* * * * *